US005280680A

United States Patent [19]

Burke et al.

[11] Patent Number: 5,280,680

[45] Date of Patent: Jan. 25, 1994

[54] SOLE WITH RESILIENT CAVITY

[75] Inventors: Robert Burke; James Russell, both of Toronto, Canada

[73] Assignee: Bata Limited, Ontario, Canada

[21] Appl. No.: 828,603

[22] Filed: Jan. 31, 1992

[51] Int. Cl.[5] ..... A43D 5/00; A43B 13/18

[52] U.S. Cl. ..... 36/28; 36/114; 36/143; 36/25 R; D2/951

[58] Field of Search ..... 36/28, 59 C, 102, 31, 36/140, 142, 143, 144, 114, 103, 25 R; D2/320, 321

[56] References Cited

U.S. PATENT DOCUMENTS

| | | | |
|---|---|---|---|
| D. 125,431 | 2/1941 | Starner | D2/320 |
| D. 125,432 | 2/1941 | Starner | D2/320 |
| D. 189,839 | 3/1961 | Nakashima | 36/59 C X |
| D 305,279 | 1/1990 | Hase | D2/320 |
| D. 309,669 | 8/1990 | Arai | D2/320 |
| 3,100,354 | 8/1963 | Lombard et al. | 36/25 R |
| 3,366,117 | 1/1968 | Schaller | 36/142 |
| 4,043,058 | 8/1977 | Hollister et al. | 36/102 |
| 4,085,527 | 4/1978 | Riggs | 36/114 |
| 4,128,950 | 12/1978 | Bowerman et al. | 36/30 R |
| 4,259,792 | 4/1981 | Halberstadt | 36/28 |
| 4,372,058 | 2/1983 | Stubblefield | 36/32 R |
| 4,697,361 | 10/1987 | Ganter et al. | 36/59 C X |
| 5,005,299 | 4/1991 | Whatley | 36/28 X |
| 5,052,130 | 10/1991 | Barry et al. | 36/114 X |

*Primary Examiner*—Steven N. Meyers
*Assistant Examiner*—BethAnne C. Cicconi
*Attorney, Agent, or Firm*—Eckert Seamans Cherin & Mellott

[57] ABSTRACT

A sole member for an article of footwear, comprises a sheet of resilient material displaying cushioning and memory properties. The sheet has a generally longitudinal cavity with outwardly flared sidewalls that deflect horizontally in the presence of a downward force. The cavity is wider in the heel region and curves outwardly toward the lateral forefoot to create a path of least resistance that causes the center of mass of the human body to migrate laterally and thereby reduce predisposition to excessive pronation.

13 Claims, 2 Drawing Sheets

SOLE WITH RESILIENT CAVITY

This invention relates to a sole member particularly suitable for use in athletic footwear but applicable to various footwear types.

In recent years there has been a trend towards the design of smart shoes that improve the comfort and gait of the wearer. For example, it is known to provide a sole with a heel cavity that deflects the downward impact forces as the heel strikes the ground outwardly to reduce the shock forces transmitted to the wearer. Such soles are designed with a memory capability so as to return energy during the upward phase of the gait.

Prior art systems are described, for example, in the following patents: PCT/DK88/00203; U.S. Pat. No. 4,372,058; European Application 89113960.0; U.S. Pat. No. 4,128,950; U.S. Pat. No. 4,085,527 and U.S. Pat. No. 4,043,058. These patents deal generally with the effect of vertical impact forces.

However, it is not only vertical forces that can cause gait-related injuries. Excessive pronation and resupination lead to tarsal and tibial torsion, wgich can cause cause knee injuries. As the heel first strikes the ground, in most people the foot is pointing outward (supinated). In the next phase of the gait, the foot turns inward (pronation) and in many people continues until the toe is poining inward (excessive pronation) with the foot flat on the ground. In the next phase of the gait the foot again starts to rotate outward (resupination). The rotation of the foot during the various phases of the gait is transmitted through the lower leg and appears at the knee joint as a torsional stress, which is imposed on the knee joint just as the vertical forces are a maximum. This causes grinding in the knee joint, resulting knee injury.

It is an object of the present invention to alleviate the aforementioned disadvantages.

According to the present invention there is provided a sole member for an article of footwear, comprising a sheet of resilient material displaying cushioning and memory properties, said sheet having a generally longitudinal cavity with outwardly flared sidewalls that deflect horizontally in the presence of a downward force, said cavity gradually extending outwardly from the heel region, where it provides a low pressure region under the calcaneous, toward the lateral forefoot so as to cause the centre of mass of the wearer to migrate laterally outward during the post-strike phase of the gait and thereby reduce the predisposition to excessive pronation, and said cavity terminating proximal the fifth metatarsal head to create a low pressure zone relative the first metatarsal head and thereby encourage resupination at toe-off.

The sole member is preferably in the form of a midsole.

The design of the cavity that curves outwardly toward the lateral forefoot encourages the center of mass of the wearer to migrate laterally over the sole after heel strike and thereby reduce the predisposition to excessive pronation. The heel region provides shock absorption and rear foot motion control. The combined result is a reduction in the likelihood of excessive pronation during the midstance phase and the encouragement of resupination in the latter phase. This reduces the occurrence of gait-related injuries associated with higher than normal impulse and excessive tarsal and tibial torsion.

The design of the midsole also has the additional advantage of an overall reduction in shoe weight.

The sole member, which is preferably in the form of a midsole, can be formed of any suitable material that displays cushioning and memory properties, that is any material that has the ability to return to its original position after defamation. Suitable materials are rubber, rubber derivatives, vinyls or vinyl derivatives.

The invention will now be described in more detail, by way of example only, with reference to the accompanying drawings, in which.

Figure 1:
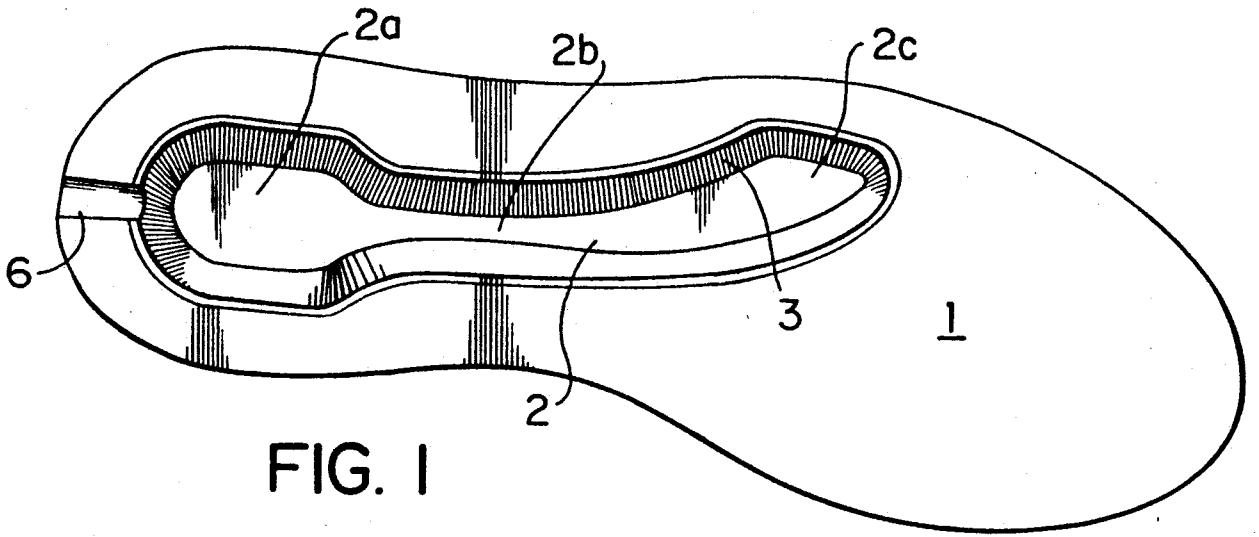
FIG. 1 is an underneath view of a first embodiment of a midsole according to the invention.
Figure 3A:
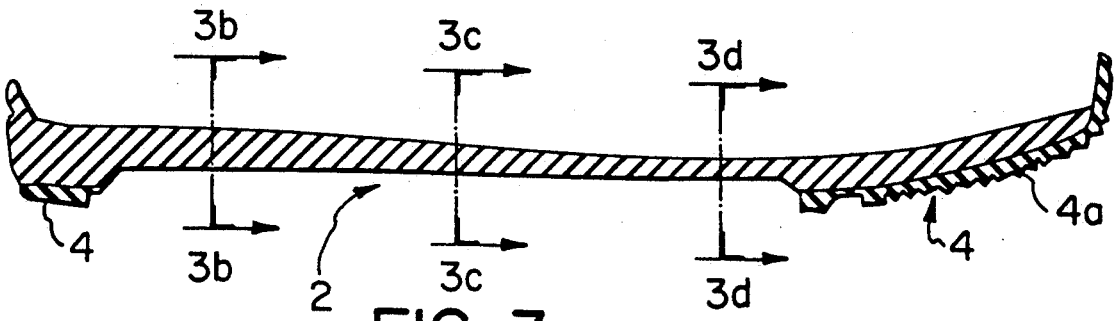
Figure 3B:
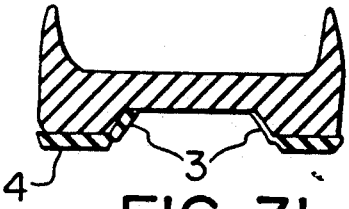
Figure 3C:
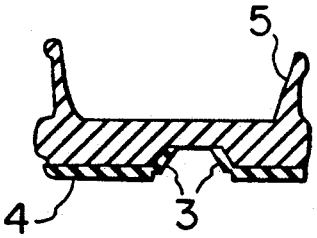
Figure 3D:
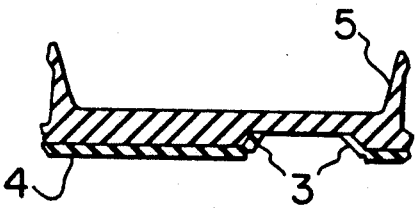

FIG. 3*a* is a cross-sectional view in the sagittal plane of the midsole shown in FIG. 1; and FIGS. 3*b* to 3*d* are respectively cross-sections along the lines B—B, C—C and D—D of FIG. 3*a*.

Referring now to FIG. 1, the midsole 1 is of conventional shoe shape and designed to be sandwiched between an outsole and insole, the combination forming the sole of an article of footwear, which may be suitably be an athletic shoe although the invention is not restricted to athletic shoes.

The midsole 1 can be formed of any suitable material that displays cushioning and memory properties such as are rubber, rubber derivatives, vinyls or vinyl derivatives.

In the middle of the bottom side of the midsole 1 is a generally longitudinally extending, elongate cavity 2, which has angled sidewalls 3. The cavity 2 curves toward the outer lateral side of the shoe, terminating at a point proximal to the fifth metatarsal head. The cavity 2 has a generally oval heel region 2*a*, tapering to a narrower waist region 2*b*, which opens out to a wider, generally V-shaped front region 2*c*.

The midsole 1 can be seen in more detail in FIGS. 3*a* to 3*b*. FIG. 3*a* clearly shows the cavity 2 which as shown in FIGS. 3*b* to 3*d*, has inclined sidewalls 3. A conventional outsole 4 with a tread 4*a* in the toe region is fitted underneath the midsole 1. The midsole also has upwardly protruding sidewalls 5 that receive the insole (not shown) and mate with the upper of the shoe.

A conventional axial channel 6 (FIG. 1) is provided in the rear heel portion of the midsole.

Figure 2:
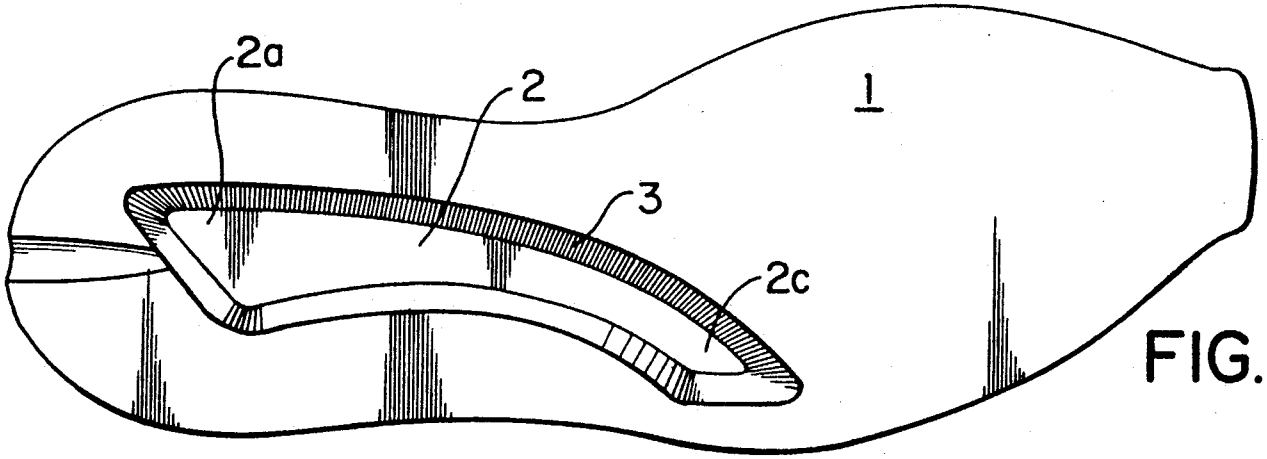
FIG. 2 is an underneath view of second embodiment of a midsole according to the invention.

An alternative configuration is shown in FIG. 2, where the cavity 2 has a generally arcuate, gradually tapering configuration from the heel region 2*a* to the forefoot region 2*c* proximal the fifth metatarsal head.

The design of the midsole is such that an area of lower pressure is created in the heel region 2*a*, and this provides shock absorption in the rear foot and motion control throughout the stance phase of gait.

The cavity is designed to perform two primary functions: The first is the dissipation of impact energy and the control of midsole deflection rates. This is accomplished by the use of the angular sidewalls on the cavity 2 which predisposes the walls of the cavity to deflect in a horizontal manner in a direction away from the source of impact. This allows an increased time period from initial contact to midstance, which decreases forces associated with the strike impulse. The movements of the cavity's sidewalls in a horizontal manner necessitate a horizontal reaction movement and therefore a horizontal reaction force component. This decreases the magnitude of the vertical reaction force component typically directed through the long axis of the tibia onward to the patella and femur. This is important because in the prior art the combined effect of high impact forces and simultaneous twisting forces at the knee joint caused torsion-related injuries.

Second, the design of the cavity 2 from the rearfoot section up to the furthest most point on the lateral side encourages ideal gait biomechanics. At heel strike the center of the calcaneous is encouraged to seat in the center of the cavity because it is the zone of lowest pressure. This is also the position which corresponds most closely to the biomechanically ideal sub talar neutral position. The effect of the low pressure region created by the cavity helps reduce early excessive pronation by reducing both the angular magnitude of the supinated position immediately following heel strike.

During the midstance phase of gait the geometry of the cavity 2 narrows and it becomes directed towards the lateral forefoot, terminating beneath the fifth metatarsal head. The design of the path of least resistance encourages the center of mass of the human body to migrate laterally over the base of support and thereby reduce the predisposition to excessive pronation.

Just prior to toe off the body's center of mass follows a path characteristic of ideal resupination. The furthermost section of the cavity 2 arcs dramatically to the lateral aspect of the forefoot just proximal to the fifth metatarsal head. This creates a zone of low pressure relative to the region proximal to the first metatarsal head. The midsole region distal to the metatarsal heads is free of any concavities to provide a stable base of support for effective propulsion.

Key aspects of the described midsole are the heel region which provides shock absorption and rearfoot motion control, and the forefoot extension which reduces the likelihood of excessive pronation during midstance and encourages resupination at toe off. The end result is the reduction in the likelihood of the occurrence of gait related injuries that are associated with higher than normal impulse and excessive tarsal and tibial torsion. The removal of midsole material also acts as a mechanism to reduce the weight of the overall shoe.

The embodiments of the invention in which an exclusive property or privilege is claimed are defined as follows:

1. A sole member for an article of footwear, comprising a sheet of resilient material displaying cushioning and memory properties, said sheet having a deep generally longitudinal, asymmetrically disposed cavity with outwardly flared sidewalls that deflect horizontally in the presence of a downward force to dissipate impact energy, said cavity having a longitudinal axis gradually turning outwardly in a direction toward the front of the sole from the heel region, where said cavity provides a low pressure region under the calcaneus, toward a lateral portion of the forefoot so as to cause the center of mass of the wearer to migrate laterally outward during the stance phase of the gait cycle and thereby reduce the predisposition to excessive pronation, and said cavity terminating beneath the fifth metatarsal head so as to create a low pressure zone thereunder relative to said first metatarsal head, said first metatarsal head being free of any such underlying cavity, and thereby encourage resupination at toe-off.

2. A sole member as claimed in claim 1, wherein said cavity curves continuously from the heel region to the lateral forefoot.

3. A sole member as claimed in claim 1, wherein the cavity comprises a generally oval heel region tapering to a narrow waist region that flares slightly to a generally V-shaped forefoot region.

4. A sole member as claimed in claim 1, wherein the cavity has generally the shape of an arcuately deformed trapezoid, gradually tapering from the heel region to a generally V-shaped forefoot region.

5. A sole member as claimed in claim 1, wherein said resilient sole member is made of a material selected from the group consisting of: rubber, rubber derivatives, vinyl, and vinyl derivatives.

6. A sole member as claimed in claim 1, wherein the sole member region distal to the metatarsal heads is free of any concavities to provide a stable base of support for effective propulsion.

7. An article of footwear, comprising:

means for at least partly enclosing a user's foot; and, a sole member attached to said means and including a sheet of resilient material displaying cushioning and memory properties, said sheet having a deep generally longitudinal asymmetrically disposed cavity with outwardly flared sidewalls that deflect horizontally in the presence of a downward force to dissipate impact energy, said cavity having a longitudinal axis gradually turning outwardly in a direction toward the front of the sole from the heel region, where said cavity provides a low pressure region under the calcaneus, toward a lateral forefoot so as to cause the center of mass of the wearer to migrate laterally outward during the post-strike phase of the gait and thereby reduce the predisposition to excessive pronation, and said cavity terminating beneath the fifth metatarsal head so as to create a low pressure zone thereunder relative to said first metatarsal head, said first metatarsal head being free of any such underlying cavity, and thereby encourage resupination at toe-off.

8. An article of footwear as claimed in claim 7, wherein said cavity curves continuously from the heel region to the lateral forefoot.

9. An article of footwear as claimed in claim 7, wherein the cavity comprises a generally oval heel region tapering to a narrow waist region that flares slightly to a generally V-shaped forefoot region.

10. An article of footwear as claimed in claim 7, wherein the cavity has generally the shape of an arcuately deformed trapezoid, gradually tapering from the heel region to a generally V-shaped forefoot region.

11. An article of footwear as claimed in claim 7, wherein said resilient sole member is made of a material selected from the group consisting of: rubber, rubber derivatives, vinyl, and vinyl derivatives.

12. An article of footwear as claimed in claim 7, wherein the sole member region distal to the metatarsal heads is free of any concavities to provide a stable base of support for effective propulsion.

13. An article of footwear as claimed in claim 7, wherein said article of footwear is in a form of an athletic shoe.

* * * * *